United States Patent [19]

Theisen

[11] 4,157,882

[45] Jun. 12, 1979

[54] DEVICE FOR SEALING BETWEEN THE ROTARY PISTON AND THE SEPARATING SLIDE OF A ROTARY ENGINE, A ROTARY PISTON PUMP, OR THE LIKE

[76] Inventor: Alois Theisen, 5581 Grenderich, Fed. Rep. of Germany

[21] Appl. No.: 852,360

[22] Filed: Nov. 17, 1977

[51] Int. Cl.[2] ..... F16J 15/16

[52] U.S. Cl. ..... 418/64; 418/137; 418/139

[58] Field of Search ..... 418/64, 137, 138, 139, 418/113; 277/81 P, 81

[56] References Cited

U.S. PATENT DOCUMENTS

| | | | |
|---|---|---|---|
| 880,009 | 2/1908 | Burton | 418/64 |
| 3,451,381 | 6/1969 | Armstrong | 418/138 |

*Primary Examiner*—Robert I. Smith
*Attorney, Agent, or Firm*—Max Fogiel

[57] ABSTRACT

A sealing arrangement in a rotary machine between the eccentric rotary piston and the separating slide engaging a recess in the piston. A spring-loaded strip is guided in a lengthwise slot of the rotary piston, and is in contact with each side wall of the separating slide throughout the entire length. The vertex formed by an obtuse angle of the front sides of the strip in the region of the center line of the strip, is in sliding-motion connection with the side wall of the separating slide. The center line of the strip forms an angle of substantially 55° with the center line of the separating slide, at dead center. Compression springs associated with the rear side of the strip are held in blind holes which are spaced by a predetermined distance. The recess of the rotary piston which accommodates the separating slide, has a trapezoidal cross-section. Facing lengthwise slots for the strips are located in the upper region of the recess of the rotary piston, and the separating slide and strips are made of materials of different hardness.

7 Claims, 2 Drawing Figures

DEVICE FOR SEALING BETWEEN THE ROTARY PISTON AND THE SEPARATING SLIDE OF A ROTARY ENGINE, A ROTARY PISTON PUMP, OR THE LIKE

BACKGROUND OF THE INVENTION

The present invention relates to a device for sealing between the eccentric rotary piston and the separating slide, engaging a recess in the rotary piston of a rotary engine, a rotary piston pump, etc.

From German Laid-Open Document No. 2 262,574 there is known a self-priming rotary piston pump with two eccentric rotary pistons staggered on one shaft. These rotate in a common cylindrical cavity divided by a wall into two chambers; the chambers are divided into pressure and suction zones by a separating slide in the form of a plate passing through the entire cavity and engaging lengthwise slots in the eccentric rotary pistons; the slide is held in radial grooves of the bearings and is supported in a recess of the transverse wall. The side walls of the separating slide have a concave recess throughout its entire length, and the lengthwise slots of the eccentric rotary pistons, which the separating slide engages, are of trapezoidal cross-section. However, it has been found in practice that the sealing between the separating slide and the individual eccentric rotary piston is not sufficient for satisfactory operation of the rotary piston pump.

There has also been proposed a rotary engine with an ignition system and a valve control providing two rotary piston cylinders and two rotary pistons which are mounted on one shaft in an offset manner to form two sickle-shaped chambers, with the two chambers being connected via a center section with recessed combustion chamber. The inside of each rotary cylinder has a separating cylinder which engages a recess of the associate rotary piston. Here also practical experience has not provided adequate sealing between separating slide and rotary piston.

Accordingly, it is the object of the present invention to provide a device of the above type as simply as possible and to assure an increase of the sealing effect between the rotary piston and the separating slide.

Another object of the present invention is to provide a device of the foregoing character which may be economically fabricated and which may be easily maintained in service.

A further object of the present invention is to provide an arrangement, as described, which has a substantially long operating life.

SUMMARY OF THE INVENTION

The objects of the present invention are achieved by providing that a spring-loaded strip guided in an associated lengthwise slot of the rotary piston is in contact with each side wall of the separating slide throughout its entire length. The tip (vertex) formed by an obtuse angle of the front sides of the strips in the region of the center line of the strip is in sliding connection with the side wall of the separating slide in order to achieve a nearly uniform pressure force distribution throughout the width of the strip. The center line of the strip preferably forms an angle of 55° with the center line of the separating slide in the dead center position.

In a further embodiment of the invention, the compression springs associated with the rear side of the strip are guided in blind holes which are a predetermined distance apart.

The important advantage achieved with the present invention is the perfect sealing during the rotation of the rotary piston between this piston and the separating slide. This increases appreciably the life time of the rotary piston pump or of the rotation engine. Even when the tips of the strips are worn, sufficient sealing is assured since the strips will always press with sufficient force on the separating slides, due to their associated compression springs.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENT

Figure 1:
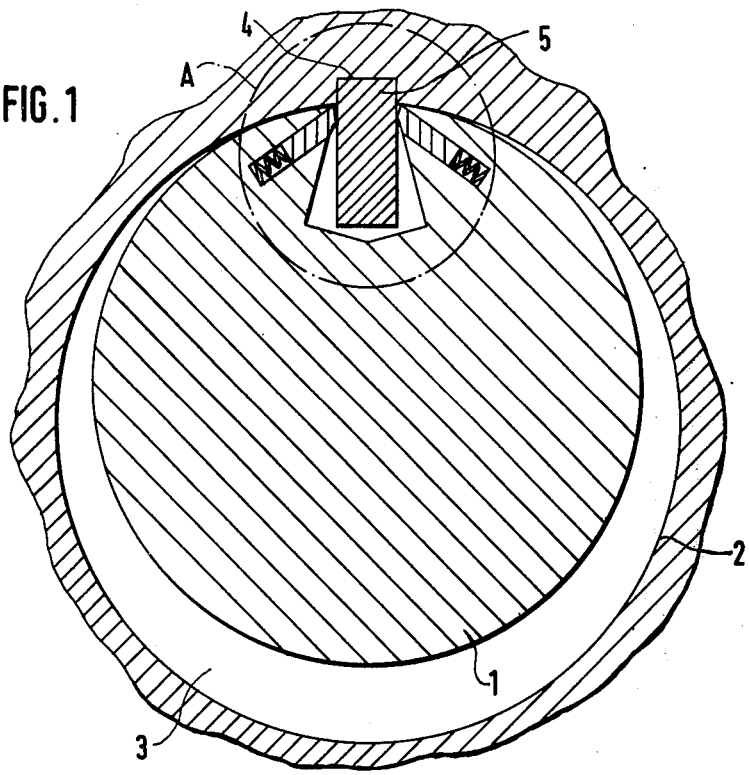
FIG. 1 shows an axial section taken through a rotary piston cylinder of a rotation engine.
Figure 2:
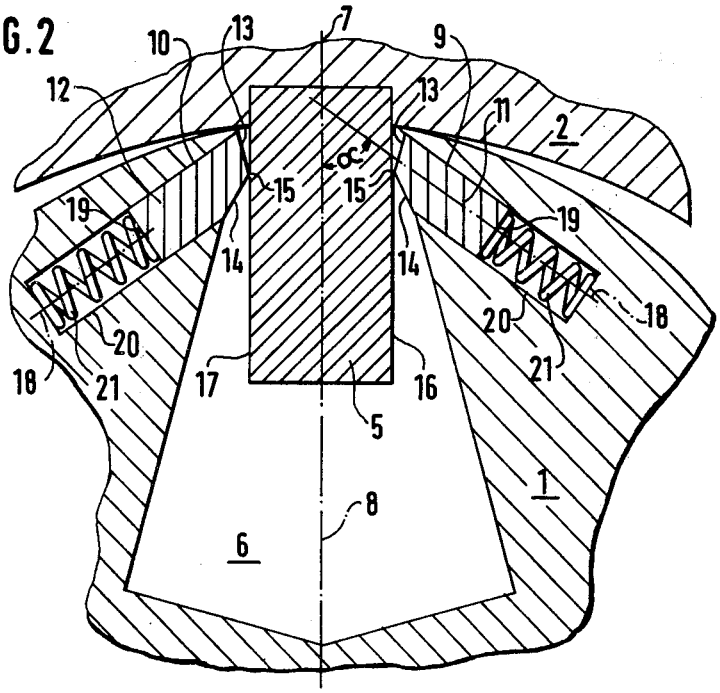
FIG. 2 shows an enlarged view of portion A of FIG. 1.

The rotary piston 1 of the rotation engine is located eccentrically in the rotary piston cylinder 2, forming the sickle-shaped chamber 3. On the inside of the rotary cylinder 2 in a lengthwise groove 4 there is the rectangular cross-section separating slide which engages a trapezoid-shaped recess 6 of the rotary piston 1. In FIG. 1, the separating slide 5 of the rotary cylinder 2 is at the so-called dead center through which the centerline 8 of rotary piston 2 passes.

The upper region of recess 6 has lengthwise facing slots 9, 10 in the rotary piston 2; in these slots, a strip 11, 12 is guided with sliding motion. The two front sides 13, 14 of strip 11, 12 form an obtuse angle whose vertex 15 contacts the associated side wall 16, 17 of the separating slide 5. Center line 18 forms an angle $\alpha=55°$ with the center line of the separating slide 5, which corresponds to the center line 8 of rotary piston 1 at dead center. Underneath this center line 18, the tip 15 of strip 11, 12 touches the associate side wall 16, 17 of separating slide 5. The rear side 19 of the strip 11, 12 guided in the lengthwise slot 9, 10 has compression springs 21 in suitably spaced blind holes 20; these springs effect steady contact of tip 15 of strip 11, 12 with the separating slide 5. It is expedient to make the separating slide 5 and strips 11, 12 of materials of different hardness.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention, and therefore, such adaptations should and are intended to be comprehended within the meaning and range of equivalence of the following claims.

I claim:

1. A sealing arrangement in a rotary machine having an eccentric rotary piston and a separating slide engaging a recess in the piston, said sealing arrangement providing a seal between the eccentric rotary piston and the separating slide and comprising: an eccentric rotary piston with a lengthwise slot; a spring-loaded strip guided in said lengthwise slot; a separating slide with side walls; said spring-loaded strip guided in said lengthwise slot of said rotary piston being in contact with each side wall of the separating slide throughout the entire length; front sides of said strip forming an obtuse angle with vertex in the region of the center line of said strip, said vertex being in sliding-motion contact with a side wall of said separating slide substantially along a line.

2. An arrangement as defined in claim 1 wherein the center line of said strip forms an angle of substantially 55° with the center line of the separating slide at dead center.

3. An arrangement as defined in claim 1 including compression springs associated with the rear side of said strip and held in blind holes spaced apart by a predetermined distance.

4. An arrangement as defined in claim 1 wherein the recess of said rotary piston for receiving said separating slide has a trapezoidal cross-section.

5. An arrangement as defined in claim 1 wherein said lengthwise slot for said strip is located in the upper portion of said recess of said rotary piston.

6. An arrangement as defined in claim 1 wherein said separating slide and said strip are comprised of materials of different hardness.

7. A sealing arrangement as defined in claim 1 wherein front sides of said strip form an obtuse angle with vertex in the region of the center line of said strip, said vertex being in sliding-motion contact with a side wall of said separating slide; the center line of said strip forming an angle of substantially 55° with the center line of said separating slide at dead center; compression spring means associated with the rear side of said strip and held in blind holes spaced apart by a predetermined distance; said recess of said rotary piston for receiving said separating slide having a substantially trapezoidal cross-section; said lengthwise slot for said strip being located in the upper region of said recess of said rotary piston; said separating slide and said strip being comprised of materials of different hardness.

* * * * *